US005421321A

United States Patent [19]

Ward

[11] Patent Number: 5,421,321

[45] Date of Patent: Jun. 6, 1995

[54] FREE-STANDING OUTDOOR FIREPLACE

[76] Inventor: Teddy L. Ward, 9817 Heath Ave. South, Cottage Grove, Minn. 55016

[21] Appl. No.: 198,039

[22] Filed: Feb. 17, 1994

[51] Int. Cl.[6] ..... F24B 1/181

[52] U.S. Cl. ..... 126/519; 126/512

[58] Field of Search ..... 126/500, 519, 531, 60, 126/520, 312, 307 R, 85 B, 512

[56] References Cited

U.S. PATENT DOCUMENTS

| | | | |
|---|---|---|---|
| 3,499,432 | 3/1970 | Hannebaum | 126/519 |
| 3,724,443 | 4/1973 | Carson | 126/515 |
| 3,910,251 | 10/1975 | Andrew | 126/519 |
| 3,970,067 | 7/1976 | Vaughn | 126/520 |
| 4,112,913 | 9/1978 | Shimek et al. | 126/519 |
| 4,131,104 | 12/1978 | Choate | 126/60 |
| 4,332,235 | 6/1982 | Hannebaum | 126/519 |
| 4,363,313 | 12/1982 | Smith | 126/9 |
| 5,284,125 | 2/1994 | Hunziker | 126/25 |

FOREIGN PATENT DOCUMENTS

| | | | |
|---|---|---|---|
| 632582 | 10/1982 | Switzerland | 126/519 |
| 682103 | 7/1993 | Switzerland | 126/500 |

OTHER PUBLICATIONS

Sierra Outdoor Portable Fireplace brochure.

Weber FirePlace Assembly Instructions, Jul. 1990.

*Primary Examiner*—James C. Yeung

*Attorney, Agent, or Firm*—Kinney & Lange

[57] ABSTRACT

A free-standing fireplace for outdoor use is disclosed. The fireplace contains a base in which a fire is made. Adjustably mounted onto the base unit are a number of side panels. The side panels are adjustably mounted onto the base to allow air to flow into the fireplace between the bottom of the side panels and the top of the base unit. At least one of the side panels is transparent to provide a pleasing view of the fire contained in the fireplace. Above the side panels is a hood, and mounted to the hood is a smoke stack.

3 Claims, 4 Drawing Sheets

FREE-STANDING OUTDOOR FIREPLACE

BACKGROUND OF THE INVENTION

The present invention relates to a free-standing fireplace for outdoor use. In particular, the present invention is a semi-portable free-standing fireplace for use outdoors, the fireplace having a base, a number of see-through side panels and a hood and chimney configuration.

Apparatuses for containing fires outdoors are not new. For example, permanent brick grills are commonly known, as are fire pits. These permanent type fire holding structures have a distinctive disadvantage of not being portable, and in the case of the fire pit not being useable on a deck or patio.

One well known grill manufacturer sells an outdoor fireplace called the Weber FirePlace. The Weber FirePlace has a number of drawbacks, such as, it can only be used on a non-combustible surface, not on a wooden deck. The surfaces of the Weber FirePlace get very hot when in use which is not safe with children present. Another drawback to the Weber FirePlace is that if there is any wind present, blowing smoke, flames and embers from the fire may harm or irritate people.

The Outdoor Cooking Store also sells a portable fireplace for outdoor use. This fireplace is simply a kettle with three legs and a screen over the top of the kettle. This fireplace has some of the same disadvantages as seen in the Weber FirePlace such as; the kettle surfaces get very hot when in use which causes a safety hazard for children, and any blowing wind may cause smoke, flames or ashes to harm or irritate people.

The present invention enables the consumer to enjoy an outdoor fire without flying ashes, smoke, and sparking embers being a concern. The present invention is also constructed to provide a safe environment for children and adults to view a fire with the flexibility of being able to move the fireplace to the location the consumer desires, including a wooden deck or a patio.

SUMMARY OF THE INVENTION

The present invention provides a semi-portable free-standing fireplace for outdoor use in a safe and aesthetically pleasing manner. The fireplace contains a base in which a fire is made. Adjustably mounted onto the base is a viewing unit. The viewing unit is adjustably mounted to allow air to flow into the base unit between the bottom of the viewing unit and the top of the base unit. The viewing unit contains a number of side panels wherein a number of the side panels are transparent to provide a pleasing view of the fire. Above the side panels is a hood, and mounted to the hood is a stack to remove the smoke.

DETAILED DESCRIPTION OF THE PREFERRED EMBODIMENTS

Figure 1:
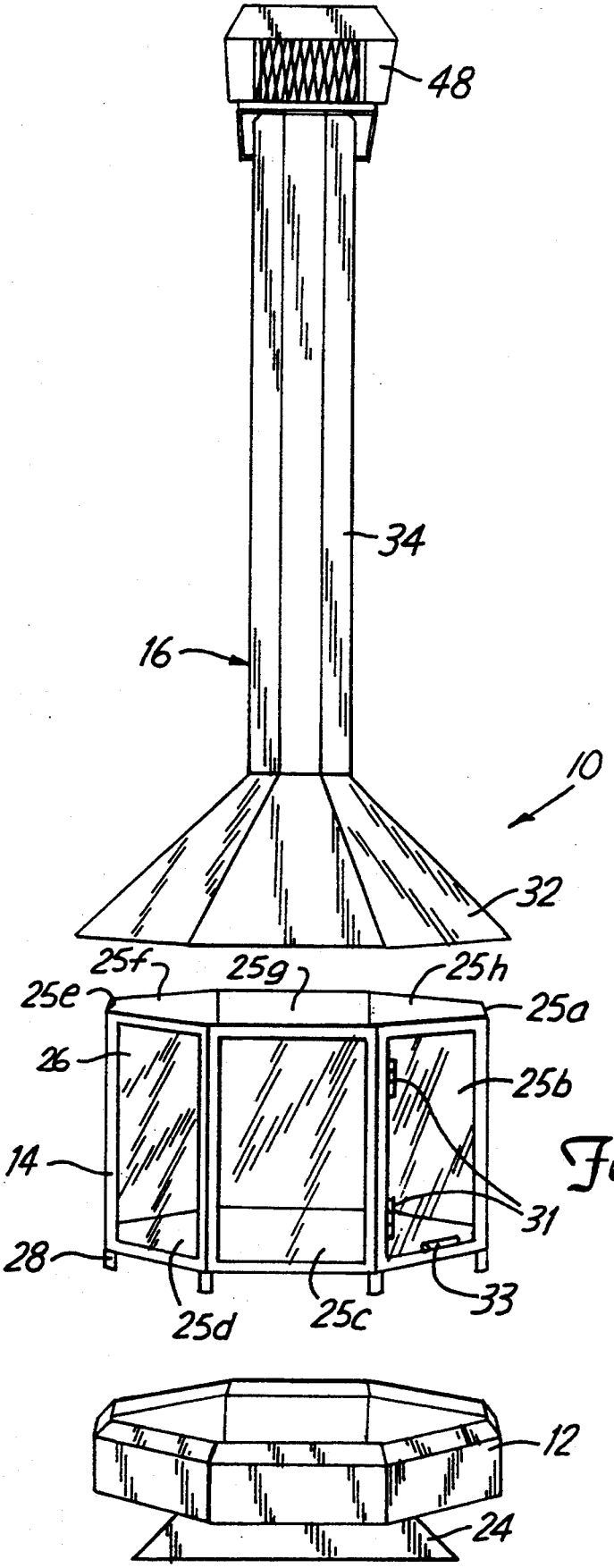
FIG. 1 is an exploded perspective view of a fireplace made according to the present invention.

A free-standing fireplace for outdoor use made according to the present invention is shown generally at 10 in FIG. 1. The fireplace to be described and illustrated in the figures is shown on a deck 9, but the fireplace may placed on any substantially flat outdoor surface such as a patio or a driveway. As can be seen clearly in FIG. 1, the fireplace 10 is composed of three main elements; a base unit 12, a viewing unit 14 and a hood and stack unit 16.

In general, the fireplace 10 works as follows. A fire is built in the base unit 12. The fireplace of the present invention has been designed to function properly in many different weather conditions including rain and snow, but care should be taken when using the outdoor fireplace 10 of the present invention in the cooler seasons to start with a gentle fire to allow the fireplace time to gradually warm up. Air to fuel the fire enters the interior of the fireplace between the top of base unit 12 and the bottom of viewing unit 14. While the fire is burning, viewing unit 14 allows people to watch the fire in a safe and comfortable atmosphere. Smoke from the fire is exhausted through the hood and stack unit 16. The hood and stack unit 16 is cooled by the outside air in a way described in detail below. By cooling hood and stack unit 16, the hood and stack unit 16 provides a safe fireplace.

Figure 2:
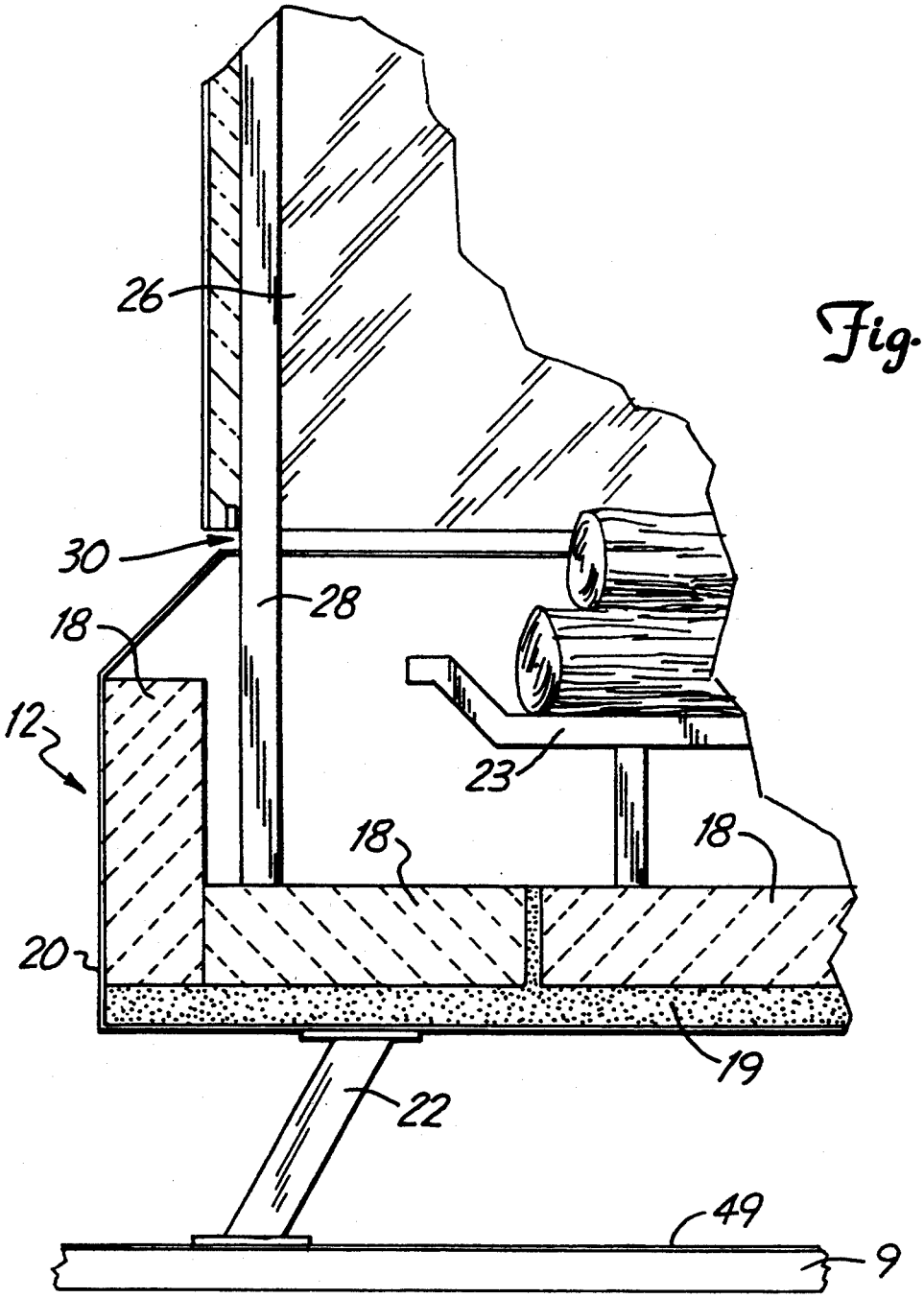
FIG. 2 is a cut away sectional view of a portion of a fireplace made according to the present invention.

Referring now to FIG. 2, the base unit 12 is comprised of a plurality of refractory bricks 18, a layer of sand 19, an outer shell 20, and either legs 22 or skirt 24. A grate 23 is typically provided to hold wood to be burned in the base unit 12. Refractory bricks 18 are used to line the base unit 12. Refractory bricks 18 line the base unit along the bottom and sides and may be cut to any size desired. In the preferred embodiment, there are approximately 32 bricks arranged in the base unit 12 to fit the desired shape of the fireplace 10. A number of smaller bricks are used as opposed to a single large refractory brick for ease of replacement and lower cost, but a single large brick may be used if desired. It should be noted that while the figures illustrate an octagonal fireplace, any shape fireplace may be made according to the present invention including square, rectangular, or round.

Each of the bricks 18 are $4\frac{1}{2}$ inches wide by $9\frac{1}{2}$ inches long and each brick is $1\frac{1}{4}$ inches thick. The bricks are spaced approximately $\frac{1}{8}$ inch apart to allow for expansion. Refractory bricks 18 are used to absorb the heat produced by the fire and to provide a level and solid surface to place grate 23. Removal of ashes is greatly simplified by building the fire on a solid surface such as bricks 18. Refractory bricks 18 also give the fireplace 10 substantial weight which allows the fireplace 10 to withstand strong winds while outdoors.

Beneath bricks 18, is a layer of sand 19. The sand 19 acts as an additional insulation layer and cushions the bricks 18. In the preferred embodiment, the sand 19 is $\frac{1}{2}$ inch thick, but more or less may be used. The outer shell 20 surrounds the refractory bricks 18 and sand 19 to enclose the base unit 12 in a finish similar to the hood and stack unit 16. In the preferred embodiment, the outer shell 20 of the base unit 12 is constructed from a single piece of 14 gauge sheet metal.

Figure 3:
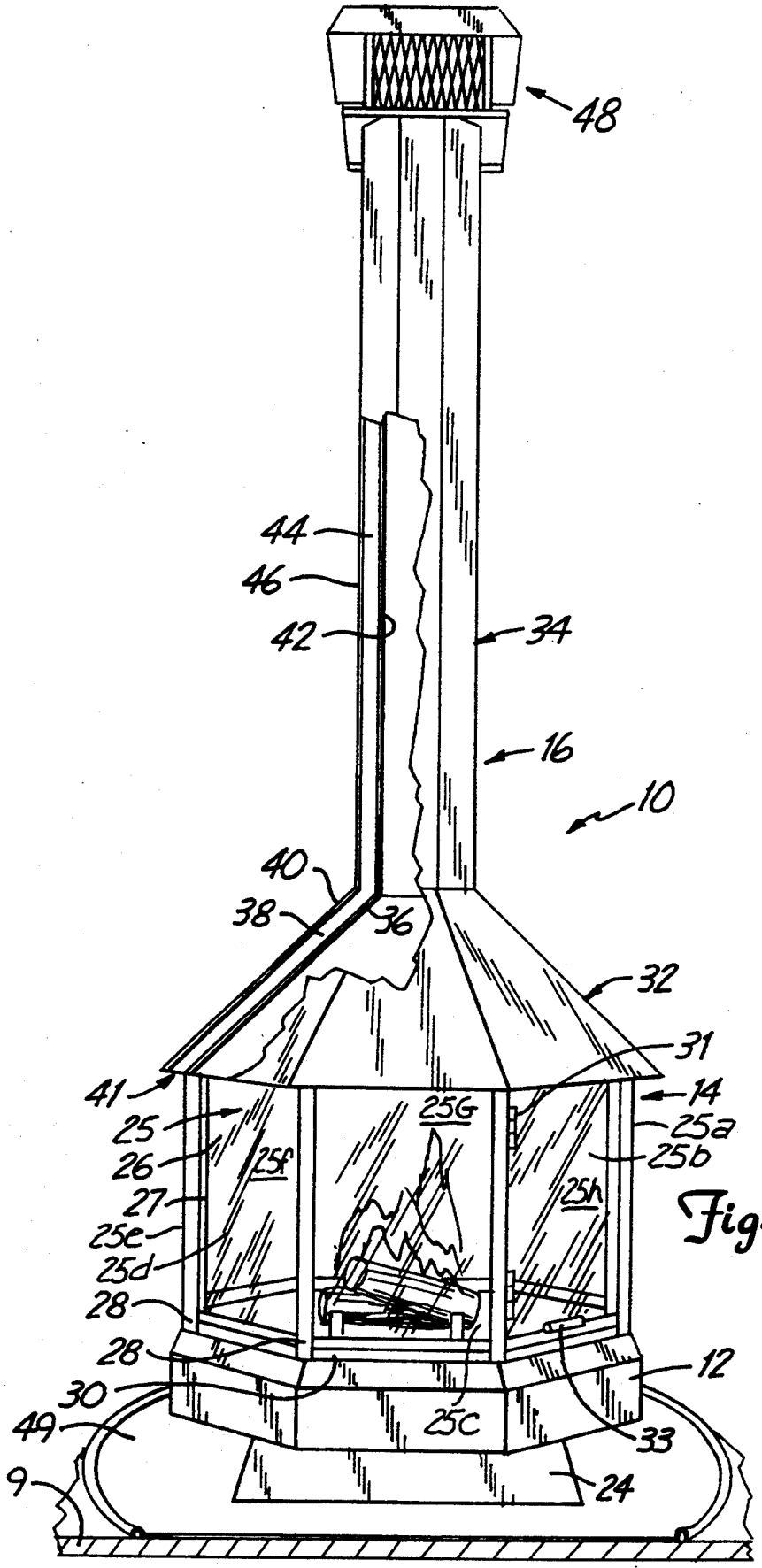
FIG. 3 is a perspective view of a fireplace made according to the present invention having a portion cut away.
Figure 4:
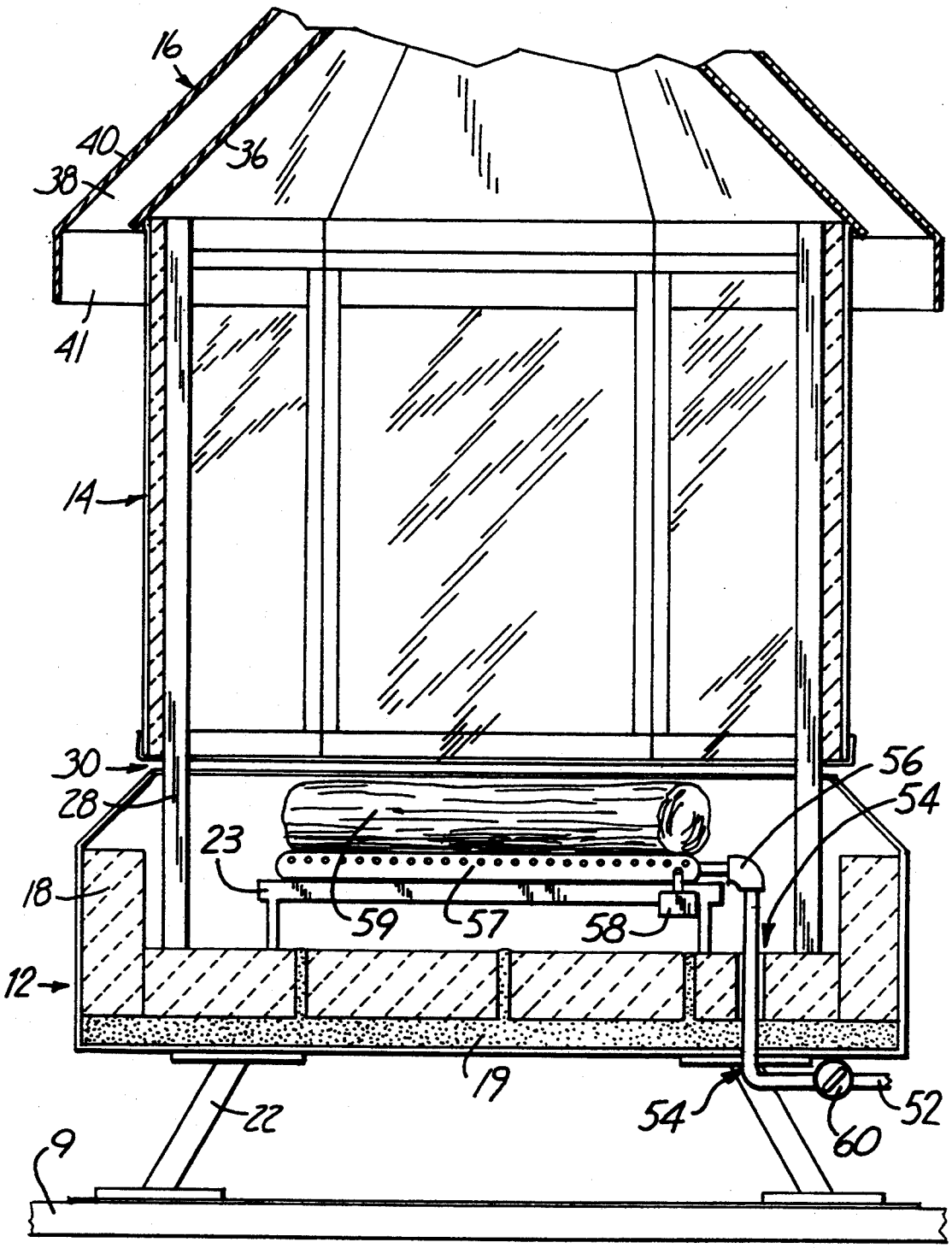
FIG. 4 is a cut away sectional view of a portion of an alternative embodiment of the present invention.

Legs 22 or skirt 24 are provided to support the shell 20, sand 19 and bricks 18. Legs 22 are shown in FIG. 2 while skin 24 is shown in FIG. 3. Both legs 22 and skirt 24 support the base unit 12 and elevate the base unit off the surface that the fireplace is being used on, which in FIGS. 1, 3, and 4 is deck 9.

Moving to FIG. 3, viewing unit 14 is shown adjustably mounted onto base unit 12. Viewing unit 14 is made up of a number of sidewalls 25*a*–25*h*. Each sidewall 25 is comprised of a panel 26 contained in its own frame 27. In the preferred embodiment, the majority of panels 26 are transparent to allow a full view of the fire contained inside. In the preferred embodiment, panels 25*a*–25*e* are made of ¼ inch thick tempered glass. One quarter inch tempered glass is used, as opposed to the standard ⅛ inch thick glass used in indoor fireplaces, to withstand the harsh operating environment associated with an outdoor fireplace. Each panel 25, is easily removable for cleaning or replacing. Panels 25*f*–25*h* are 14 gauge steel similar to the outer shell 20 of base unit 12. Viewing unit 14 may also be made of all transparent panels if desired.

Support posts 28 are provided to support the sidewalls 25. Support posts 28 rest on bricks 18. As can be seen in FIG. 3, there is an air intake opening 30 between the bottom of sidewalls 25 and the top of the base unit 12. The size of air intake opening 30 may be adjusted by adding or subtracting sand 19 in the base unit 12, or by using shims beneath the support posts 28. In *the preferred embodiment, the air intake opening 30 is one inch. A one inch air intake opening 30 provides an optimal amount of air for a gently burning fire.

Hinges 31 are provided to allow at least one of the panels 26 to be pivotally mounted to at least one support post 28. It is desirable to have at least one panel 26 pivotally mounted to allow access to the base unit 12 for adding fire wood. In the preferred embodiment, only one panel is pivotally mounted with hinges 31, but more panels may be mounted as so if desired. A handle 33 is also provided on the panels 26 which are pivotally mounted to aid in opening those panels.

The hood and stack unit 16 mounts onto the viewing unit 14. Hood and stack unit 16 is comprised of a hood 32 and a smoke stack 34. The hood 32 is constructed to be of the same shape as the base unit 12 but of a slightly larger diameter. It is of a larger diameter so that it overhangs the sidewalls 25 of viewing unit 12 slightly. As illustrated in FIG. 3, the hood 32 comprises an inner wall 36, an air pocket 38, and an outer wall 40. Inner wall 36 and outer wall 40 are made of 14 gauge sheet metal. Using a double wall construction has two desirable results. The first is that it provides for an insulating air layer and the second is that it gives the hood added weight to withstand high winds and other forces associated with being outdoors.

Air pocket 38 is provided to act as an insulating layer to prevent the outer wall 40 from becoming extremely hot. This makes the fireplace 10 as safe as possible for use around children. In the preferred embodiment, the air pocket 38 is approximately 1½ inches. Air pocket 38 is vented to the atmosphere through an opening 41 to provide a cooling flow of ambient air to help cool the hood and stack unit 16. When the hood 32 is placed on the viewing unit 14, a substantially air tight seal is formed between the inner wall 36 and the sidewalls 25, thus preventing smoke from escaping from under the hood 32.

The smoke stack 34 connects to the top of hood 32. Smoke stack 34 comprises an inner stack 42, air gap 44, and an outer stack 46. The inner stack 42 is formed to be tubular in shape and made of stainless steel and has a diameter of eight inches. The outer stack 46 is formed to be the same shape as the base unit 12 and is made of 14 gauge sheet metal. As in the hood, the double walled construction serves both to insulate and stabilize the smoke stack 34. The air gap 44 between the inner stack 42 and the outer stack 46 is approximately 1½ inches and is in communication with air pocket 38 of the hood 32, thus the stack is also cooled by the ambient air received through opening 41. This again prevents the outer stack 46 from becoming extremely hot. The interior of inner stack 42 is open to the interior of the hood 32 to allow smoke contained by the hood 32 to travel up the stack 34.

A screen 48 is mounted to the top of smoke stack 34. Screen 48 prevents any hot embers or ashes that may have travelled up the smoke stack 34 from entering the atmosphere and possibly falling to the deck 9 causing a fire or falling on someone causing injury, or from floating up and injuring birds. The screen used in the preferred embodiment is a spark arrester commonly used on chimneys and readily available.

The sheet metal used in the outer shell 20, panels 25*f*–25*h*, hood 32 and outer stack 46 in the preferred embodiment are all 14 gauge sheet metal. Each of these surfaces is coated with a porcelain finish or high temperature paint to prevent rusting, a common occurrence with untreated metal surfaces left outdoors.

An additional safety feature provided with the wood-burning fireplace 10 when used on a combustible surface such as deck 9, is a spark shield 49. The spark shield 49, is placed around the fireplace 10 to prevent any embers or ashes that may happen to spit out of the air intake opening 30 (very rare) or to prevent any embers or ashes that may fall out of one of the pivotally mounted panels 26 when opened to add wood to the fire from igniting the deck. The spark shield 49 should be galvanized sheet metal or aluminum with a minimum thickness of 18 gauge. Steel should not be used as it will rust and stain the deck 9 the fireplace is being used on.

The fireplace 10 illustrated in FIGS. 1–4, is designed to be semiportable, yet sturdy enough to withstand high winds and other elements associated with being outdoors. As illustrated in FIG. 1, the hood and stack unit 16 lifts off of viewing unit 14. Hood and stack unit weighs approximately 70 pounds. As an additional safety feature, in order to remove the hood and stack unit 16 from viewing unit 14, the hood and stack unit 16 must be raised vertically approximately one inch, to allow the outer edge of the hood to clear the viewing unit, before it can be moved horizontally. This prevents the hood and stack unit from simply being pushed over either by someone or by a strong wind. With hood and stack unit 16 off, viewing unit 14 is then removable from the base unit 12. With the hood and stack unit 16 removed and the viewing unit 14 removed, base unit 12 may then be moved to a new desired location. Because of the refractory bricks 18, base unit 12 is fairly heavy, weighing approximately 300 pounds. Although it is fairly heavy, base unit 12 may be moved by one or more people.

The wood burning fireplace 10 described above is also easily convertible to burn natural gas or liquid petroleum (LP). Illustrated in FIG. 4 is a fireplace that has been converted for natural gas or LP use. Because of the similarities between the wood burning fireplace 10 and gas fireplaces corresponding elements will be labeled the same.

A gas converted fireplace is shown generally at 50 in FIG. 4. As with the wood burning fireplace 10, fireplace 50 is composed of three main elements, base unit 12, viewing unit 14, and hood and stack unit 16. The viewing unit 14 and hood and stack unit 16 do not change at all in the gas burning fireplace 50. The base unit 12 has some slight alterations.

A fuel line 52, which runs to a fuel source not shown, is provided through a hole 54 cut out of both the refractory bricks 18 and the outer shell 20. A commonly used coupling 56 and burner 57 are connected to the fuel line 56 to provide a flame when ignited. A commonly used spark igniter 58 is provided adjacent to the burner 57 to ignite the flame when fuel is provided to the burner 57.

Ceramic logs 59 replace real wood logs on grate 23 when converting to natural gas or LP use. A shut-off valve 60 is provided on fuel line 52 remote from the fireplace 50. This allows the operator to extinguish the fire without reaching inside the fireplace 50. As in the previous wood-burning fireplace 10, at least one of the panels 26 is pivotally mounted to at least one support post 28. This allows the operator to reach into the fireplace 50 and operate the spark igniter 58 to ignite the fuel coming out of burner 57.

Although the present invention has been described with reference to preferred embodiments, workers skilled in the art will recognize that changes may be made in form and detail without departing from the spirit and scope of the invention.

What is claimed is:

1. A free-standing fireplace for outdoor use comprising:

a base unit having base insulating and stabilizing means for insulating and stabilizing the base unit to allow the base unit to withstand conditions associated with being outdoors;

a viewing unit adjustably mounted to the base unit for allowing air to flow into the fireplace, the viewing unit comprising a plurality of side panels defining an interior and an exterior of the fireplace, whereby at least one of the side panels is transparent to allow viewing of the interior of the fireplace, and wherein the at least one transparent side panel is at least substantially one quarter inch thick tempered glass to withstand conditions associated with having a fire outdoors;

a hood mounted onto the viewing unit, the hood having a top portion and a bottom portion, the bottom portion of the hood extending below a portion of the viewing unit to help prevent the hood from being blown sideways off the viewing unit, the hood having inner and an outer walls around the hood with an air gap therebetween and wherein the air gap is open to the atmosphere at the bottom portion of the hood to allow air to enter the air gap to cool the hood to provide a hood that is safe to the touch while the fireplace is operated, and wherein the inner wall of the hood forms an inner cavern for unobstructedly guiding exhaust air from the fire upwards; and a smoke exhaust stack connected to the hood and having an inner and outer wall with an air gap therebetween wherein the air gap of the stack is in communication with the air gap of the hood to allow an unimpeded flow of ambient air to cool the stack such that it is safe to the touch and wherein the inner wall of the stack forms an inner cylinder in communication with the inner cavern of the hood to allow the unimpeded flow of exhaust air upwards.

2. A three piece, semi-portable, free-standing fireplace for outdoor use, the fireplace comprising:

a base unit having base insulating and stabilizing means for insulating and stabilizing the base unit to allow the base unit to withstand conditions associated with being outdoors;

a viewing unit adjustably mounted to the base unit for allowing air to flow into the fireplace, the viewing unit comprising a plurality of side panels defining an interior and an exterior of the fireplace, whereby at least one of the side panels is transparent to allow viewing of the interior of the fireplace, and wherein the at least one transparent side panel is at least substantially one quarter inch thick tempered glass to withstand conditions associated with having a fire outdoors; and a hood and stack unit mounted onto the viewing unit, the hood having a top portion and a bottom portion, the bottom portion of the hood extending below a portion of the viewing unit to help prevent the hood from being blown sideways off the viewing unit, the hood having inner and an outer walls around the hood with an air gap therebetween and wherein the air gap is open to the atmosphere at the bottom portion of the hood to allow air to enter the air gap to cool the hood to provide a hood that is safe to the touch while the fireplace is operated, and wherein the inner wall of the hood forms an inner cavern for unobstructedly guiding exhaust air upwards, the stack being connected to the hood and having an inner and outer wall with an air gap therebetween wherein the air gap of the stack is in communication with the air gap of the hood to allow an unimpeded flow of ambient air to cool the stack such that it is safe to the touch and wherein the inner wall of the stack forms an inner cylinder in communication with the inner cavern of the hood to allow the unimpeded flow of exhaust air upwards and wherein the stack is of a sufficient height to propel the exhaust away from those viewing the fireplace.

3. A three piece, semi-portable, free-standing fireplace for outdoor use, the fireplace comprising:

a base unit having base insulating and stabilizing means for insulating and stabilizing the base unit wherein the base unit weighs approximately 300 pounds to allow the base unit to withstand conditions associated with being outdoors, the insulating and stabilizing means comprising an outer shell, a layer of sand at a bottom of the outer shell and at least one brick positioned on the layer of sand wherein the at least one brick substantially covers the bottom of the outer shell;

a viewing unit adjustably mounted to the base unit for allowing air to flow into the fireplace, the viewing unit comprising a plurality of side panels defining an interior and an exterior of the fireplace, whereby at least one of the side panels is transparent to allow viewing of the interior of the fireplace, and wherein the at least one transparent side panel is at least substantially one quarter inch thick tempered glass to withstand conditions associated with having a fire outdoors; and a hood and stack unit mounted onto the viewing unit, the hood having a top portion and a bottom portion, the bottom portion of the hood extending below a portion of the viewing unit to help prevent the hood from being blown sideways off the viewing unit, the hood having inner and an outer walls around the hood with an air gap therebetween and wherein the air gap is open to the atmosphere at the bottom portion of the hood to allow air to enter the air gap to cool the hood to provide a hood that is safe to the touch while the fireplace is operated, and wherein the inner wall of the hood forms an inner cavern for unobstructedly guiding exhaust air upwards, the stack being connected to the hood and having an inner and outer wall with an air gap therebetween wherein the air gap of the stack is in communication with the air gap of the hood to allow an unimpeded flow of ambient air to cool the stack such that it is safe to the touch and wherein the inner wall of the stack forms an inner cylinder in communication with the inner cavern of the hood to allow the unimpeded flow of exhaust air upwards and wherein the stack is of a sufficient height to propel exhaust away from those viewing the fireplace, and wherein the stack includes a spark arresting device mounted to the stack for preventing hot embers or ashes from entering the atmosphere.

* * * * *